US010244825B2

(12) United States Patent
Greenham

(10) Patent No.: US 10,244,825 B2
(45) Date of Patent: Apr. 2, 2019

(54) ADJUSTABLE BELT

(71) Applicant: Mark Greenham, Mount Lawley (AU)

(72) Inventor: Mark Greenham, Mount Lawley (AU)

( * ) Notice: Subject to any disclaimer, the term of this patent is extended or adjusted under 35 U.S.C. 154(b) by 79 days.

(21) Appl. No.: 15/397,518

(22) Filed: Jan. 3, 2017

(65) Prior Publication Data

US 2017/0188665 A1 Jul. 6, 2017

(30) Foreign Application Priority Data

Jan. 5, 2016 (AU) ..... 2016900020

(51) Int. Cl.

| | |
|---|---|
| ***A41F 9/02*** | (2006.01) |
| ***A41F 9/00*** | (2006.01) |
| ***A44B 11/00*** | (2006.01) |
| ***A44B 11/22*** | (2006.01) |

(52) U.S. Cl.

CPC ..... *A44B 11/008* (2013.01); *A41F 9/002* (2013.01); *A41F 9/025* (2013.01); *A44B 11/22* (2013.01)

(58) Field of Classification Search

CPC .. A41F 9/002; Y10T 24/4047; Y10T 24/4736; Y10T 24/3423; A44B 11/006; A44B 11/24

See application file for complete search history.

(56) References Cited

U.S. PATENT DOCUMENTS

| | | | | | |
|---|---|---|---|---|---|
| 327,216 | A * | 9/1885 | Adams | A41D 25/12 | 24/56 |
| 919,622 | A * | 4/1909 | McComb | B42F 13/12 | 23/302 T |
| 1,167,639 | A * | 1/1916 | Eifel | B42F 13/12 | 281/27.3 |
| 1,559,291 | A * | 10/1925 | Simmons | A41F 9/002 | 2/322 |
| 1,622,954 | A | 3/1927 | Macheroux | | |
| 1,833,175 | A * | 11/1931 | Pollock | A41F 9/002 | 2/322 |
| 2,159,857 | A * | 5/1939 | Mix | A41F 9/002 | 2/301 |
| 2,718,043 | A * | 9/1955 | Wallace | A44B 11/24 | 24/178 |
| 2,916,742 | A * | 12/1959 | Sobel | A41F 9/002 | 2/322 |
| 3,017,641 | A * | 1/1962 | Stollman | A41F 9/002 | 2/322 |
| 3,440,667 | A | 4/1969 | Dye | | |

(Continued)

OTHER PUBLICATIONS

Wikipedia contributors, "Snap fastener," Wikipedia, The Free Encyclopedia, https://en.wikipedia.org/w/index.php?title=Snap_fastener&oldid=857864573 (accessed Dec. 17, 2018) (Year: 2018).*

*Primary Examiner* — Robert H Muromoto, Jr.

(74) *Attorney, Agent, or Firm* — Martin IP Pty Ltd

(57) ABSTRACT

An adjustable best for wear about a waist of a person is provided. The adjustable belt includes an overlapping portion that is folded back to form a buckle loop, a buckle captured by the buckle loop and a securing mechanism that secures the overlapping portion of the belt folded back. The belt has a length or a size which is adjustable by varying the length of the overlapping portion. The securing mechanism belt may include one or more studs receivable in one or more holes.

17 Claims, 5 Drawing Sheets

(56) References Cited

U.S. PATENT DOCUMENTS

| | | | | | |
|---|---|---|---|---|---|
| 3,828,370 | A * | 8/1974 | Ihmels | A41F 9/002 | 2/322 |
| 4,430,015 | A * | 2/1984 | Nerlinger | B65H 3/00 | 402/500 |
| 4,470,174 | A * | 9/1984 | Rhea | A41F 9/002 | 24/16 PB |
| 5,806,087 | A | 9/1998 | Grotefend | | |
| 5,826,280 | A * | 10/1998 | Bradley | A44B 11/006 | 2/322 |
| 6,044,496 | A * | 4/2000 | Ramirez | A41F 9/025 | 2/219 |
| 6,082,600 | A * | 7/2000 | Angus | A45C 1/04 | 224/236 |
| D446,906 | S * | 8/2001 | Lackman | D2/627 | |
| 6,339,848 | B1 * | 1/2002 | Mayhood | A41F 9/002 | 2/338 |
| 7,178,364 | B2 * | 2/2007 | Shapiro | A44C 5/102 | 59/80 |
| D578,751 | S * | 10/2008 | Holtzclaw, Jr. | D3/224 | |
| 7,895,675 | B2 * | 3/2011 | Curphey | A63B 21/065 | 2/338 |
| 8,015,623 | B2 * | 9/2011 | Lee | A41F 9/002 | 2/311 |
| D726,993 | S * | 4/2015 | Ermel | D2/627 | |
| 2005/0050615 | A1 * | 3/2005 | Stickney | A41F 9/002 | 2/311 |
| 2010/0071116 | A1 | 3/2010 | Burch | | |

* cited by examiner

ADJUSTABLE BELT

FIELD

The present invention relates to an adjustable belt for wear about a waist of a person. In particular, the invention relates to an adjustable belt wherein the length of the belt may be adjusted at the buckle end of the belt.

CROSS-REFERENCE TO RELATED APPLICATION

This application claims the benefit of Australian Provisional Application Number 2016900020, filed Jan. 5, 2016, the subject matter of which is incorporated herein by reference in its entirety.

BACKGROUND

Dress belts for wear about a waist of a person are generally adjustable using a buckle which engages a selected one of a series of spaced buckle holes in a free end of the belt.

The buckle holes are commonly spaced an inch apart along the belt. Many people find the inch increments of size adjustability too generous. The belt may fit too tight with the prong of the buckle in one hole, but moving the buckle to a neighbouring hole may again result in the belt fitting too loose.

There is a limit on how close the buckle holes can be spaced from one another. Spacing the buckle holes too close may lead to the prong ripping a tear between the holes, effectively ruining the belt.

SUMMARY

According to one broad aspect of the present disclosure, although not necessarily the broadest aspect, there is provided an adjustable belt for wear about a waist of a person, including: an overlapping portion of the belt which is folded back to form a buckle loop. The overlapping portion has a length. The belt includes a buckle captured by the buckle loop. The adjustable belt may include a tongue at a region distal to the buckle, the tongue including a series of buckle holes which the buckle engages to secure the belt in a belt loop. A securing mechanism of the belt secures the overlapping portion of the belt folded back along an overlapped portion of the belt. The securing mechanism may include at least one stud and at least one hole configured for engagement with the, or each, stud. The belt has a length or a size which is adjustable by varying the length of the overlapping portion.

According to another broad aspect of the present disclosure, there is provided an adjustable belt for wear about a waist of a person, including a distal end which is folded back to form a buckle loop. The buckle loop has a length. A buckle of the belt is captured by the buckle loop. A tongue at a region distal to the buckle may be included, the tongue including a series of buckle holes which the buckle engages to secure the belt in a belt loop. The belt includes a securing arrangement for securing an overlapping portion of the distal end along an overlapped portion of the belt so that the buckle loop is adjustable. The securing arrangement may include a securing mechanism including at least one stud and at least one hole configured for engagement with the, or each, stud.

The belt may have a length between a free end of the belt and a buckle end of the belt. The length of the belt may be adjustable by varying the length of the overlapping portion of the belt or varying the size of the buckle loop. The belt may be configured so that varying the length of the overlapping portion of the belt varies the size of the buckle loop.

The securing arrangement to secure the overlapping portion along an overlapped portion of the belt may be the securing mechanism configured to releasably secure the overlapping portion of the belt folded back.

The securing mechanism may comprise one or a series of holes in the overlapped portion of the belt and one or more studs on the overlapping portion of the belt. The studs may be receivable in different ones of the holes to adjust the length of the belt. Alternatively, the securing mechanism may include one or more studs on the overlapped portion of the belt and one or a series of holes in the overlapping portion of the belt.

The, or each, stud may include a head arranged at an end of an elongate member. The elongate member may be narrower than the head. The head may be an enlarged head. The, or each, stud is preferably receivable in the, or each, hole. The head may be configured to be received in the, or each, hole.

The, or each, hole may include an elongate slot configured to receive and secure the elongate member of the, or each, stud. The elongate slot may extend from a substantially circular opening of the, or each, hole.

The belt may preferably comprise a belt strap and a buckle.

According to yet another broad aspect of the present disclosure, there is provided a method of adjusting the length of a waist belt, the method including folding an overlapping portion of the waist belt back to form a buckle loop in which a buckle is captured, selecting the length of the overlapping portion of the waist belt which is folded back so as to adjust the length of the waist belt, and releasably securing the overlapping portion of the waist belt folded back and preferably releasably securing the overlapping portion of the waist belt folded back along an overlapped portion of the waist belt to the overlapped portion by securing at least one stud to at least one hole configured for engagement with the, or each, stud.

The method of adjusting the length of a waist belt may include adjusting the length of a waist belt using the adjustable belt of any one of the aforementioned aspects.

The reference to any prior art in this specification is not, and should not be taken as an acknowledgement or any form of suggestion that the prior art forms part of the common general knowledge.

It will be appreciated that reference herein to "preferred" or "preferably" is intended as exemplary only.

The claims as filed and attached with this specification are hereby incorporated by reference into the text of the present description.

DETAILED DESCRIPTION OF THE DRAWINGS

Figure 1:
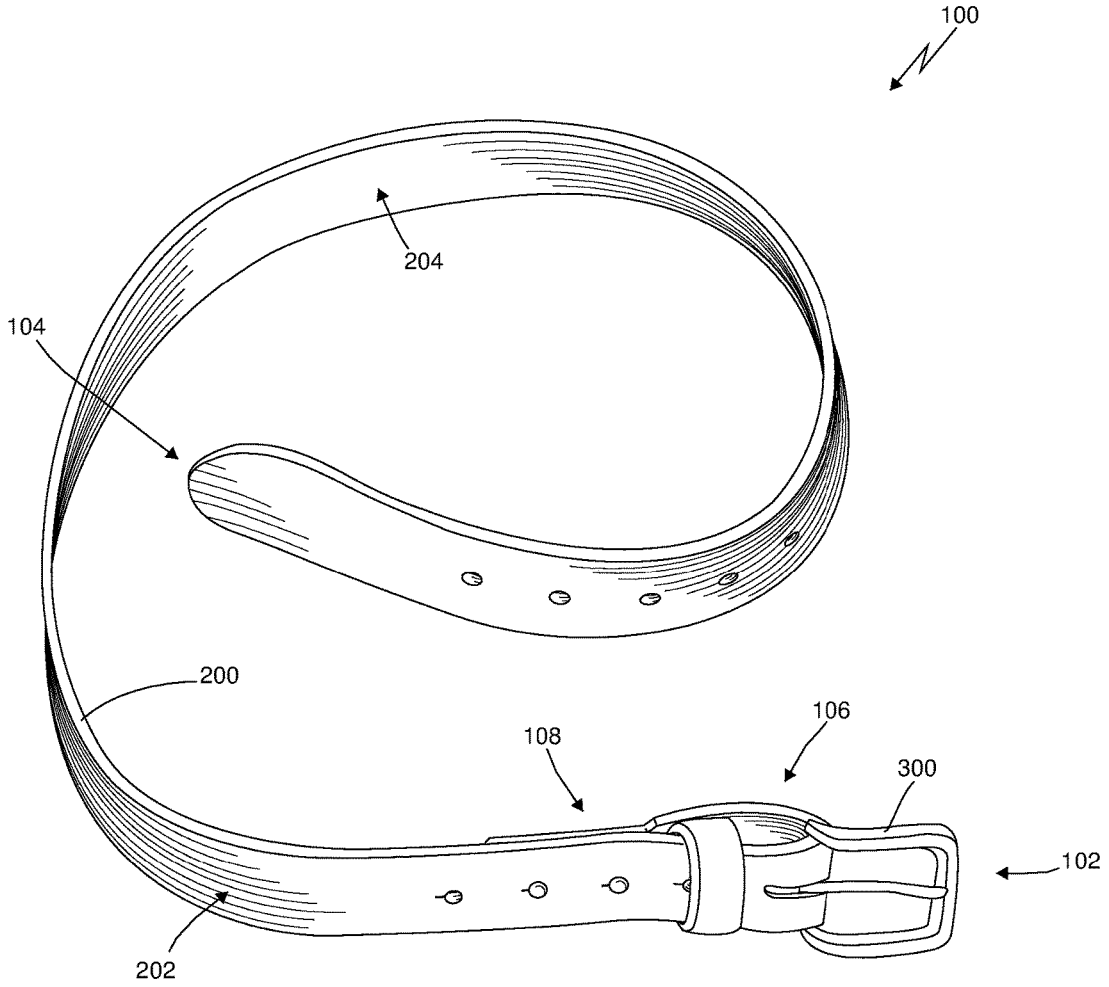
FIG. 1 is a perspective view of an embodiment of a belt in accordance with the present disclosure.

Referring to FIG. 1, a waist belt 100 has a buckle end 102 and a free end 104. Belt 100 includes a belt strap 200 and a buckle 300. Buckle 300 is captured by a buckle loop 106 of belt 100 at buckle end 102 of belt 100.

Figure 2:
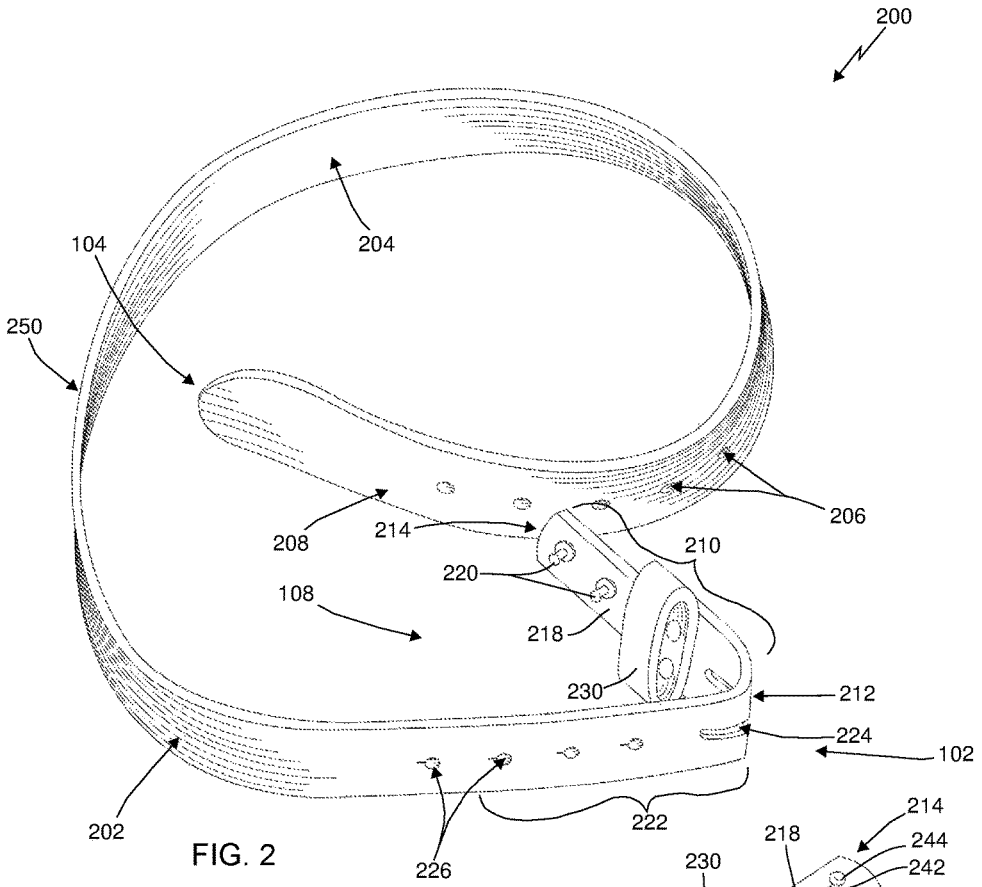
FIG. 2 is a perspective view of a belt strap of the belt of FIG. 1.

FIG. 2 shows belt strap 200. As shown in FIGS. 1 and 2, belt strap 200 has an outwardly facing side 202 and an inwardly facing side 204. Belt strap 200 may be of any suitable material for a waist belt, including leather, synthetic or faux leather, web material, plastics material and/or cloth.

Referring to FIG. 2, a series of buckle holes 206 are formed in a tongue region 208 of belt strap 200. Tongue region 208 terminates at free end 104 of belt strap 200.

Belt strap 200 has an overlapping portion 210 at buckle end 102. Overlapping portion 210 is folded back towards belt strap 200 to form loop 106 shown in FIG. 1. Overlapping portion 210 extends from a fold 212 to a distal end 214 of overlapping portion 210. Overlapping portion 210 has a length measured from fold 212 to distal end 214. Fold 212 is at buckle end 102 of belt strap 200.

Belt strap 200 has a belt size measured from fold 212 to a central one of buckle holes 206. The belt size is typically the same or one to two inches larger than the trouser size of the wearer. Belts are typically, although not exclusively, available in sizes ranging from 16 inches to 60 inches with one inch size increments between sizes.

Overlapping portion 210 of belt strap 200 includes a securing strip 218 which is suitably narrower than the remainder of belt strap 200. It will be appreciated that securing strip 218 may vary in width and shape as desired. Securing strip 218 extends to distal end 214. Belt strap 200 includes at least one, more preferably at least two spaced fasteners in the form of button studs 220 fixed to securing strip 218. Button studs 220 project from inwardly facing side 204 of belt strap 200.

Figure 3:
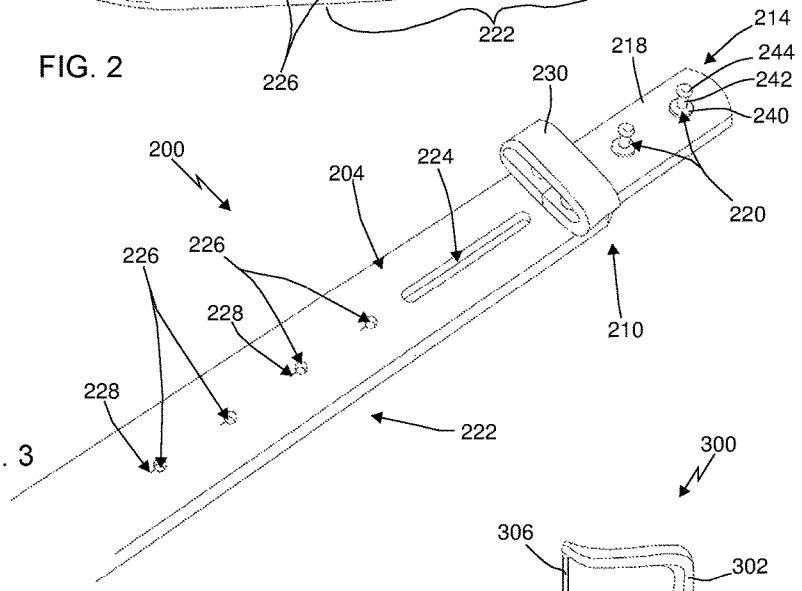
FIG. 3 is a perspective view of a buckle end region of the belt strap of FIG. 2.

Referring to FIGS. 2 and 3, an elongate hole or slot 224 is formed in the section of belt strap 200 forming loop 106. Slot 224 intersects fold 212 when loop 106 is formed.

A series of four stud holes 226 are formed in an overlapped portion 222 of belt strap 200 leading to slot 224. Stud holes 226 are complementary to button studs 220. If desired, the belt may be formed with more or less stud holes. For example, the belt may have as few as two stud holes 226 for complementary engagement with a single stud. Overlapping portion 210 is folded back so that button studs 220 can be received in stud holes 226 to releasably secure overlapping portion 210 to inwardly facing side 204 of overlapped portion 222.

Securing arrangement in the form of a securing mechanism 108 of belt 100, to releasably secure overlapping portion 210 of belt strap 200 folded back, includes button studs 220 and stud holes 226. Button studs 220 hook into stud holes 226. Securing mechanism 108 may alternatively include snap fasteners, hook and loop fasteners (e.g., Velcro), screw studs, stay puts, hooks in general, harness posts, magnet buttons, detachable rivets and studs in general, key posts, screw rivets, Sam Browns (usually attached with a press or hammer), sling studs with pins, posts with detachable C rings, string clips (e.g., string windable around the circumference of the post of a large button), a metal flat bar hook attached at the end of the strap (i.e., thin, flexible metal band with a short hook at the end, the end hook having a width approximately half the width of the strap and insertable into corresponding slots, which are oriented perpendicular to the longitudinal axis of the strap), a pair of right angle L-shaped hooks (individually twistable and insertable into corresponding slots oriented parallel along the length of the strap), a pair of generally T-shaped hooks (individually twistable and insertable into corresponding slots oriented parallel along the length of the strap), pin fasteners, antiluce fasteners, turn button fasteners, canopy stay puts, set end clasps, nipple dome screws, bag feet, and buttons (or any combination thereof).

As shown in FIG. 3, stud holes 226 are equally spaced from each other along overlapped portion 222 of belt strap 200. In the embodiment shown in the figures, stud holes 226 have the same spacing as buckle holes 206. Stud holes 226 are typically spaced at one inch (2.54 cm) intervals. Stud holes 226 may, however, have any spacing therebetween as desired. For example, stud holes 226 may each be spaced apart from one another in the range of ¼ inch to 2 inches, including equal spacing of ¼ inch, ½ inch, ¾ inch, 1 inch, 1 and ¼ inch, 1 and ½ inch, 1 and ¾ inch, or 2 inches between stud holes 226. Stud holes 226 may have the same size openings as buckle holes 206. The opening of the stud holes 226 may be larger than the openings of buckle holes 206, or vice versa.

Continuing with FIG. 3, button studs 220 each include a base 240, a neck 242 and an enlarged head 244. Neck 242 extends between base 240 and head 244. Neck 242 is narrower than head 244. Base 240 is fixed to the inwardly facing side 204 of belt strap 200.

In one embodiment, not shown, the button stud 220 closest to fold 212 is larger than the button stud 220 further away from fold 212. In an example where there are three or more button studs, the button studs may decrease in size from the button stud closest to fold 212 to the button stud furthest away from the 212. In use, the button stud 220 closest to fold 212 has a greater pulling force acting on it to release it from stud holes 226 then the pulling force on the button stud 220 furthest from fold 212.

Each stud hole 226 defines an opening having a diameter the same or slightly narrower than the diameter of head 244. Stud holes 226 each have a slit 228 extending from the opening. Slit 228 allows the opening of stud hole 226 to enlarge as head 244 passes through stud hole 226 when securing or releasing securing strip 218 to overlapped portion 222. Neck 242 of button stud 220 is seated in the opening of stud hole 226 when securing strip 218 is secured to overlapped portion 222. Head 244 of button stud 220 prevents release of securing strip 218 from overlapped portion 222 without sufficient force to pull head 244 through the opening of stud holes 226.

Belt strap 200 includes a keeper loop 230 fixed to inwardly facing side 204 of overlapping portion 210. Keeper loop 230 is riveted to inwardly facing side 204 of belt strap 200, but may be fixed by stitching or any other suitable means. Keeper loop 230 extends in a direction transverse to the longitudinal direction of belt strap 200. Keeper loop 230 has a passage of sufficient size to receive the tongue region 208. Keeper loop 230 may be formed from a metal, wood, leather, plastic, cloth, or any other material as desired.

Alternatively, the keeper loop may be omitted depending upon the belt configuration. For example, free end 104 may include a stud configured to engage one of the holes 226 to secure the free end.

Belt strap 200 includes two sets of holes, namely stud holes 226 and buckle holes 206. As shown in particular in FIG. 2, a central portion 250 of belt strap 200 extends between stud holes 226 and buckle holes 206. Central portion 250 has no holes. Central portion 250 makes up the majority of the length of belt strap 200. In a different embodiment, stud holes 226 and buckle holes 206 are not spaced from each other, but meet each other so that the majority of the length of belt strap 200 is holed.

Figure 4:
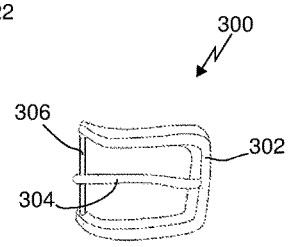
FIG. 4 is a perspective view of a buckle of the belt of FIG. 1.

Referring to FIG. 4, buckle 300 includes a frame 302 and a hinged tang/tongue or prong 304. Frame 302 has a post 306 about which the prong 304 is hinged. Buckle 300 is a conventional frame-type belt buckle. It will be appreciated that buckle 300 may be a "center post" type buckle wherein the prong attaches to a central post of the frame. Buckle 300 may be any type of belt buckle which is configured to be captured by a loop, including plate or Western style buckles having a projecting hook, or frame-type buckles with knurled sliding bars. Buckle 300 is preferably of a metal material, but may be of any suitable material including plastics and composites.

Figure 5:
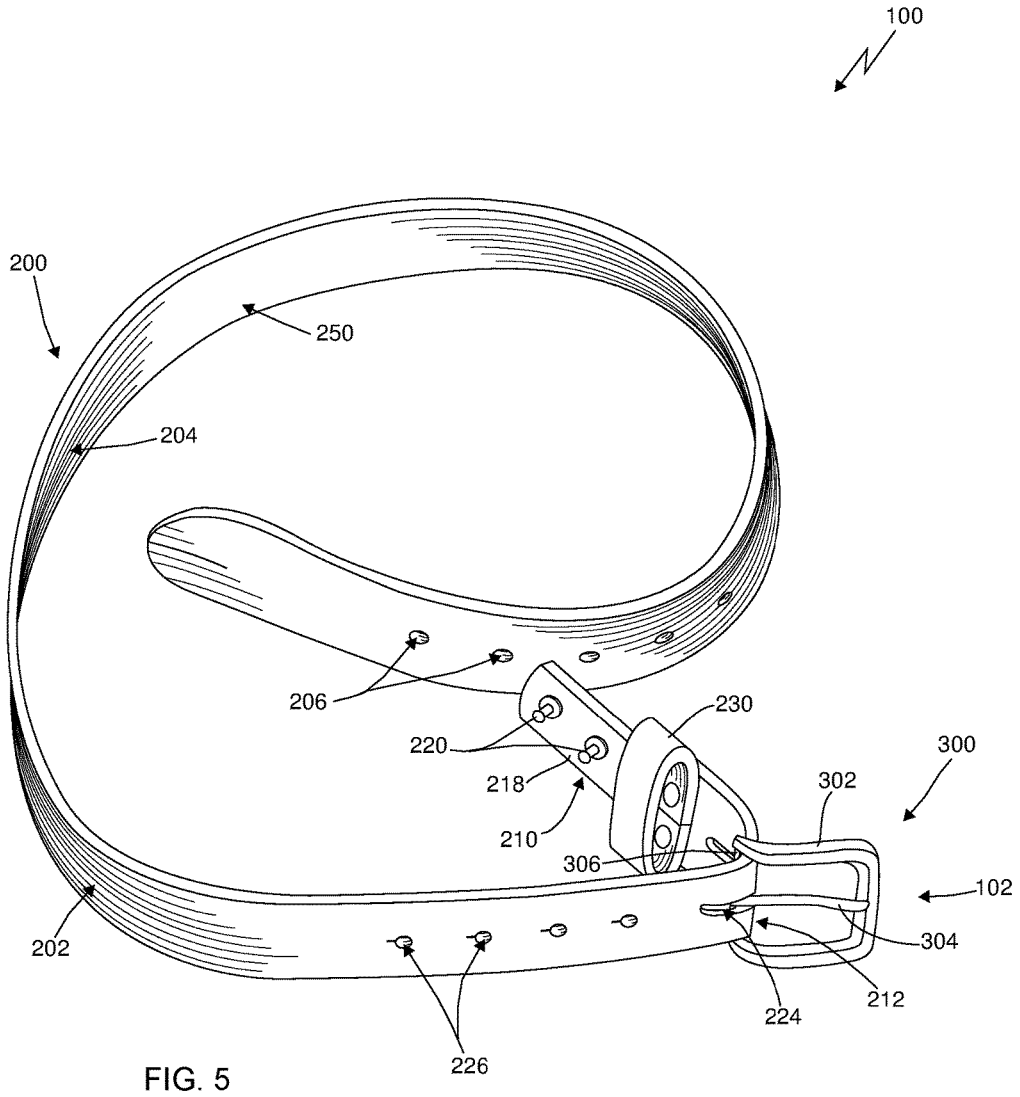
FIG. 5 is a perspective view of the belt of FIG. 1, showing an overlapping portion of the belt strap unhooked from an overlapped portion of the belt strap.

Referring to FIG. 5, buckle 300 is captured by belt strap 200 by feeding overlapping portion 210 of belt strap 200 through frame 302 so that post 306 is on the inwardly facing side 204 of belt strap 200. Prong 304 extends through the slot 224.

Figure 6:
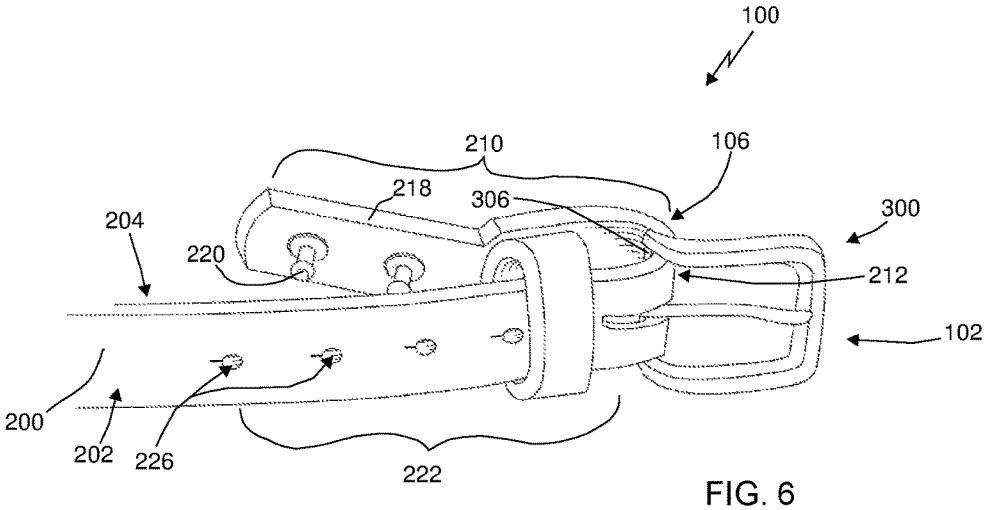
FIG. 6 is a perspective view of the buckle end region of the belt of FIG. 1, showing the overlapping portion of the belt strap folded back to be adjacent an overlapped portion of the belt strap.

Overlapping portion 210 is folded back to be adjacent overlapped portion 222 of belt strap 200 as shown in FIG. 6. Buckle post 306 seats in fold 212 in loop 106. Studs 220 are brought into alignment with selected stud holes 226 open to the back 204 of belt strap 200. Folding overlapping portion 210 back forms loop 106 and fold 212 in loop 106. The length of overlapping portion 210 is selected by selecting specific stud holes 226 into which to insert studs 220.

Figure 7:
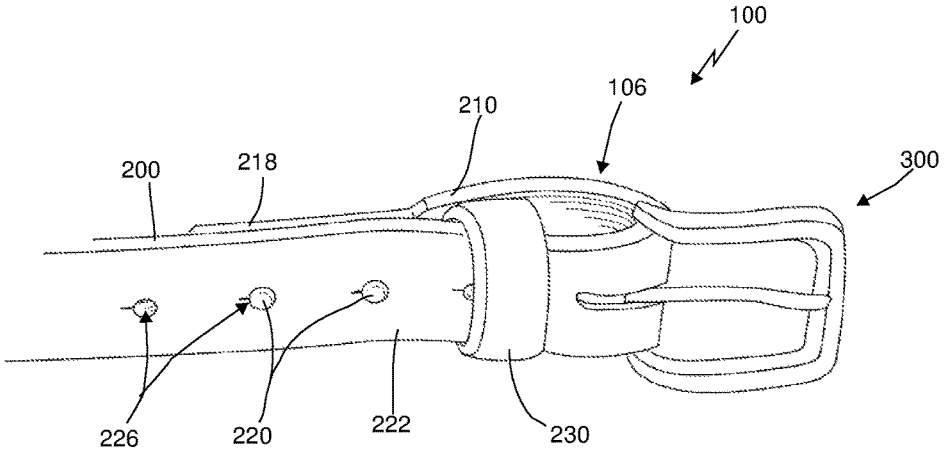
FIG. 7 is a perspective view of the buckle end region of the belt of FIG. 1, showing the overlapping portion of the belt strap releasably secured to the overlapped portion of the belt strap.

FIG. 7 shows studs 220 inserted into the central two stud holes 226. Relocating the securing strip 218 of the overlapping portion 210 so that studs 220 are received in the two stud holes 226 furthest from the buckle end 102 lengthens overlapping portion 210, thereby shortening belt 100 by approximately half the distance overlapping portion 210 lengthens. Conversely, relocating overlapping portion 210 so that studs 220 are received in the two stud holes 226 closest to buckle end 102 shortens overlapping portion 210, thereby lengthening belt 100 by approximately half the distance overlapping portion 210 shortens.

Lengthening and shortening belt 100 adjusts the length of belt 100 measured from buckle end 102 to free end 104. Lengthening and shortening belt 100 also adjusts the size of belt 100 measured from fold 212 to a central one of buckle holes 206. In the embodiment shown in the figures where stud holes 226 are spaced 1 inch apart, belt 100 may thus be shortened or lengthened by ½ inch increments by moving studs 220 between different stud holes 226.

Moving the studs 220 between different stud holes 226 also adjusts the size of buckle loop 106. The smaller buckle loop 106, the longer belt 100. The bigger buckle loop 106 the shorter belt 100. Buckle loop 106 is smallest when studs 200 are received in the two stud holes 226 closest from buckle end 102. Buckle loop 106 is largest when studs 220 are received in the two stud holes 226 furthest to buckle end 102.

The position of buckle 300 along belt strap 200 changes as the length of overlapping portion 210, and hence the size of loop 106, is adjusted. The length of slot 224 is chosen so that fold 212 intersects slot 224 for all size adjustments of buckle loop 106. This allows buckle post 306 to always seat in buckle loop 106 in a position wherein prong 304 can pass through slot 224. A slot may not be required at all for certain types of buckles which are prongless.

A person wears belt 100 about his/her waist by threading belt 100 through belt loops of the garment the person is wearing. The wearer can make coarse adjustments of the belt 100 by selecting the buckle hole 206 into which prong 304 of buckle 300 is inserted. Fine adjustment of the length of belt 100 can then be made by adjusting the length of overlapping portion 210 as discussed.

The belt may be configured to just tighten or just loosen. For example, where there is only three button stud holes, ½ inch adjustment would only be able to move in one direction only once. Whether it tightens or loosens is dependent on which two holes the ½ inch adjustment is fastened in when the belt is initially worn by a person. If the ½ inch adjustment is in the two holes closest to buckle, it would only tighten. If the ½ inch adjustment is in the two holes farthest from the buckle, it would only loosen (because there are only three holes). This could also be achieved by having two button stud holes and only one button stud.

After a person has put on the belt, and the ½ inch adjustment is in the two holes closet to the buckle, the belt is as loose as it can go and is only able to tighten. If the person decides they want the belt a ½ inch tighter, all they need to do is adjust the ½ inch adjustment to the two holes furthest from the buckle. However, if the person wants to make the belt a ½ inch looser, they could loosen the belt at the tongue by 1 inch, then tighten the adjustment at the buckle by ½ inch. Even though the ½ inch adjustment was as loose as it could go (could only tighten), the belt is still loosened by ½ an inch.

By juggling the tongue holes and the ½ inch adjustment at the belt buckle, it is still achievable to adjust the belt a ½ inch tighter or looser for each size even though the ½ inch adjustment is only able move in one direction.

Although fine adjustment of belt 100 has been described by moving the studs 220 between different stud holes 226, the spacing of stud holes 226 may be selected for coarse adjustment. That is to say that the spacing of stud holes 226 may be more than double the spacing of buckle holes 206 to allow 1 inch or bigger adjustments of the length of the belt 100 using the securing mechanism 108.

Figure 8:
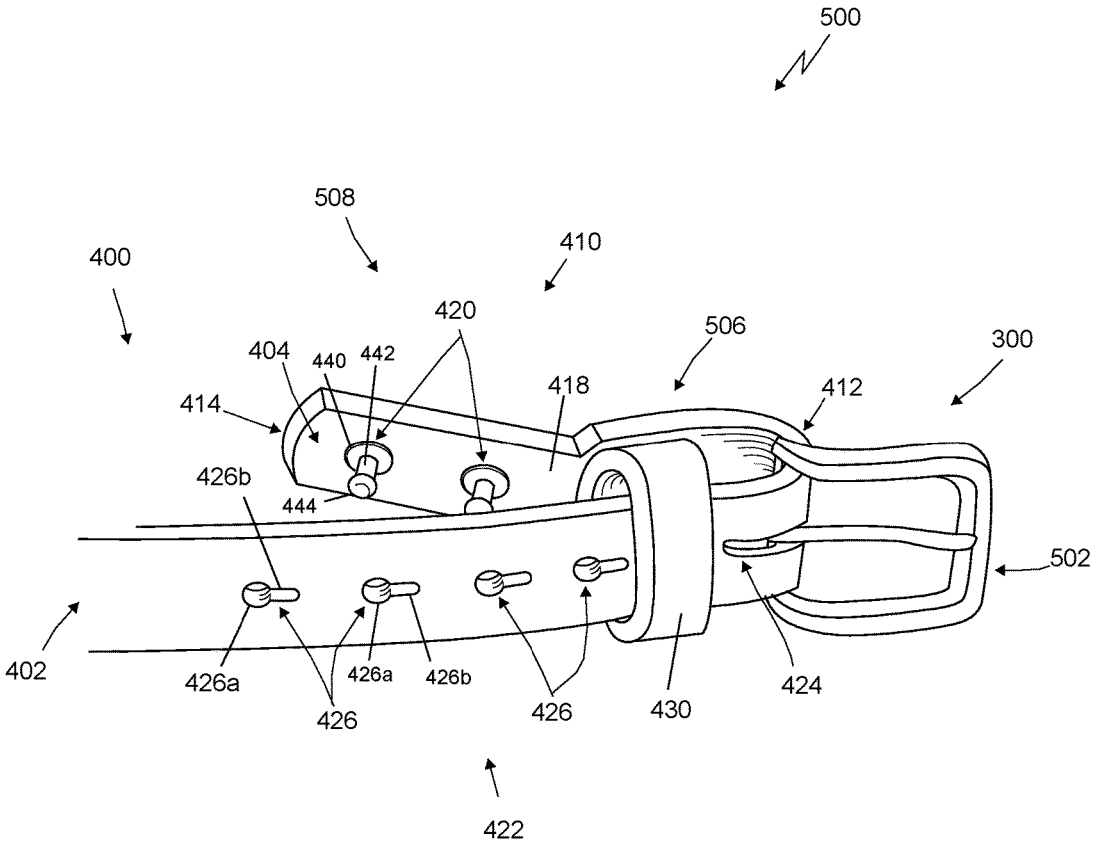
FIG. 8 is a perspective view of a further embodiment of a belt in accordance with the present disclosure.

Referring to FIG. 8, a belt 500 is shown in accordance with an alternative embodiment of the present disclosure. Belt 500 is similar to belt 100 except that belt strap 400 includes an alternative securing mechanism. Belt 500 includes belt strap 400 and buckle 300. As described above, buckle 300 is captured by a buckle loop 506 at a buckle end 502 of belt 500. Belt strap 400 includes an outwardly facing side 402 and an inwardly facing side 404. Belt strap 400 includes an overlapping portion 410 at buckle end 502. Overlapping portion 410 is folded back towards belt strap 400 to form buckle loop 506. Overlapping portion 410 extends from a fold 412 to a distal end 414 of overlapping portion 410. Fold 412 is at buckle end 502 of belt strap 400. Overlapping portion 410 has a length measured from fold 412 to distal end 414. Belt strap 400 includes a keeper loop 430.

Overlapping portion 410 of belt strap 400 includes a securing strip 418 which is narrow than the remainder of belt strap 400. Securing strip 418 may vary in width and shape as desired. Securing strip 418 extends to distal end 414. A securing arrangement in the form of a securing mechanism 508 of belt 500 to releasably secure overlapping portion 410 of belt strap 400 folded back, includes button studs 420 and stud holes 426. Button studs 420 hook into stud holes 426. Belt strap 400 includes at least one, more preferably at least two spaced fasteners in the form of button studs 420 fixed to securing strip 418. Button studs 420 project from inwardly facing side 404 of belt strap 400. An elongate hole or slot 424 is formed in the section of belt strap 400 forming buckle loop 506. Slot 424 intersects fold 412 when buckle loop 506 is formed.

In the depicted exemplary embodiment, a series of four stud holes 426 are formed in an overlapped portion 422 of belt strap 400 leading to slot 424. Stud holes 426 are for complementary engagement with buttons studs 420. Belt strap 400 may be formed with more or less stud holes 426 and may have any spacing therebetween, as desired. Overlapping portion 410 is folded back so that button studs 420 can be received in stud holes 426 to releasably secure overlapping portion 410 to inwardly facing side 404 of overlapped portion 422.

Button studs 420 each include a base 440, an elongate member in the form of a neck 442 and a head in the form of an enlarged head 444. Neck 442 extends between base 440 and head 444. Neck 442 is narrower than head 444. Base 440 is fixed to the inwardly facing side 404 of belt strap 400.

Each stud hole 426 defines an opening for receiving button stud 420. Stud holes 426 each have an elongate slot or passage in the form of a neck 426*b* extending from a substantially circular opening in the form of a head 426*a*. The combination of neck 426*b* and head 426*a* may be considered a keyhole-like shape. Accordingly, the elongate slot may be narrower than the substantially circular opening. Enlarged head 444 of button stud 420 passes through head 426*b* of stud hole 426. When neck 442 of button stud 420 engages with neck 426*b* of stud hole 426, tension is added to neck 442, thus securing button stud 420 in place.

Indicia may be placed on the belt to facilitate user adjustment. For example, numbers or symbols may be placed on the interior or exterior to assist the user with adjusting the belt to their preferred size.

Alternative embodiments of the present disclosure will be apparent to those of ordinary skill in the art from consideration of the specification and practice of the disclosure herein. It is intended that the specification and examples be considered as exemplary only, with a true scope and spirit of the present disclosure being indicated by the claims which follow. It will be understood that the term "comprising" is intended to have a broad, open meaning and not limited to a particular embodiment.

What is claimed is:

1. An adjustable belt for wear about a waist of a person, including:

an overlapping portion of the belt which is folded back to form a buckle loop, the overlapping portion having a length;

a buckle captured by the buckle loop;

a tongue at a region distal to the buckle, the tongue including a series of buckle holes which the buckle engages to secure the belt in a belt loop; and a securing mechanism to secure the overlapping portion of the belt folded back along an overlapped portion of the belt, the securing mechanism including at least one stud and at least one hole configured for engagement with the, or each, stud, wherein the belt has a length which is adjustable by varying the length of the overlapping portion so that lengthening the overlapping portion shortens the length of the belt by half the length of the overlapping portion, wherein the, or each, stud includes a head arranged at an end of an elongate member; wherein the, or each, stud is receivable in the, or each, hole; and wherein the, or each, hole includes an elongate slot configured to receive and secure the elongate member, the elongate slot extending from a substantially circular opening of the, or each, hole.

2. The adjustable belt of claim 1, wherein the securing mechanism includes the, or each, hole on the overlapped portion and the, or each, stud on the overlapping portion.

3. The adjustable belt of claim 1, wherein the securing mechanism includes the, or each, stud on the overlapped portion and the, or each, hole on the overlapping portion.

4. The adjustable belt of claim 1, wherein the belt is configured so that varying the length of the overlapping portion of the belt varies the size of the buckle loop.

5. An adjustable belt for wear about a waist of a person, including:

a distal end which is folded back to form a buckle loop, the buckle loop having a length;

a buckle captured by the buckle loop;

a tongue at a region distal to the buckle, the tongue including a series of buckle holes which the buckle engages to secure the belt in a belt loop; and a securing arrangement to secure an overlapping portion of the distal end along an overlapped portion of the belt so that the buckle loop is adjustable, wherein the securing arrangement includes a securing mechanism including at least one stud and at least one hole configured for engagement with the, or each, stud, wherein the, or each stud includes a head arranged at an end of an elongate member; wherein the, or each, stud is receivable in the, or each, hole; and wherein the, or each hole includes an elongate slot configured to receive and secure the, or each, elongate member, the elongate slot extending from a substantially circular opening of the, or each, hole, wherein the belt has a length which is adjustable by varying a length of the overlapping portion so that lengthening the overlapping portion shortens the length of the belt by half the length of the overlapping portion.

6. The adjustable belt of claim 5, wherein the securing mechanism includes the, or each hole on the overlapped portion and the, or each, stud on the overlapping portion.

7. The adjustable belt of claim 5, wherein the securing mechanism includes the, or each, stud on the overlapped portion and the, or each, hole on the overlapping portion.

8. The adjustable belt of claim 5, wherein said elongate slot extends in a longitudinal direction along the belt.

9. The adjustable belt of claim 5, wherein said elongate slot extends from said substantially circular opening towards said buckle when said buckle is captured by said buckle loop.

10. The adjustable belt of claim 5, wherein said elongate slot extends from said substantially circular opening and away from said buckle when said buckle is captured by said buckle loop.

11. The adjustable belt of claim 5, further comprising a plurality of studs for engagement with a plurality of holes, said studs decreasing in size in a direction away from said buckle when said buckle is captured by said buckle loop.

12. The adjustable belt of claim 5, wherein the belt has a length from said distal end to said tongue, a majority of the length of the belt including a plurality of buckle holes and said holes configured to receive the, or each, stud.

13. The adjustable belt of claim 1, wherein said elongate slot extends in a longitudinal direction along the belt.

14. The adjustable belt of claim 1, wherein said elongate slot extends from said substantially circular opening towards said buckle when said buckle is captured by said buckle loop.

15. The adjustable belt of claim 1, wherein said elongate slot extends from said substantially circular opening and away from said buckle when said buckle is captured by said buckle loop.

16. The adjustable belt of claim 1, further comprising a plurality of studs for engagement with a plurality of holes, said studs decreasing in size in a direction away from said buckle when said buckle is captured by said buckle loop.

17. The adjustable belt of claim 1, wherein the belt has a length from said distal end to said tongue, a majority of the length of the belt including a plurality of buckle holes and said holes configured to receive the, or each, stud.

* * * * *